United States Patent [19]

Dean

[11] Patent Number: 4,972,888

[45] Date of Patent: Nov. 27, 1990

[54] BLADE-CARRYING DRUM ASSEMBLY FOR CHIP SLICING MACHINES

[75] Inventor: Donald A. Dean, Marysville, Wash.

[73] Assignee: Acrowood Corporation, Everett, Wash.

[21] Appl. No.: 436,373

[22] Filed: Nov. 14, 1989

[51] Int. Cl.[5] ..... B27L 11/02; B27C 1/00

[52] U.S. Cl. ..... 144/172; 144/174; 241/89.3; 241/95; 241/85

[58] Field of Search ..... 144/162 R, 163, 172, 144/174, 176; 241/89.3, 95, 92, 91, 85

[56] References Cited

U.S. PATENT DOCUMENTS

| | | | |
|---|---|---|---|
| 2,874,909 | 2/1959 | Pallmann | 241/93 |
| 3,913,643 | 10/1975 | Lambert | 144/172 |
| 4,047,670 | 9/1977 | Svensson | 144/176 |
| 4,235,382 | 11/1980 | Smith | 241/85 |
| 4,298,044 | 11/1981 | Hansel et al. | 144/176 |
| 4,503,893 | 3/1985 | Demopoulos | 144/176 |
| 4,583,574 | 4/1986 | Pallmann | 144/172 |
| 4,604,925 | 8/1986 | Wisdom | 144/162 R |
| 4,796,818 | 1/1989 | Thoma | 241/85 |

*Primary Examiner*—W. Donald Bray
*Attorney, Agent, or Firm*—Seed and Berry

[57] ABSTRACT

A drum assembly for wood chip slicing machines in which the slicing blades are clamped at the discharge openings in a rotary drum between clamping plates and the trailing ends of combination plates have wear plate and clamping functions. Studs anchored in the combination plates pass through the drum, and some of them additionally pass through the clamping plates so that when nuts on the studs are tightened, the combination plates, clamping plates, slicing blades, and the drum are secured together. The clamping plates have feet which engage the drum to serve as a stop to keep the cutting edge of the blades at a predetermined setting. The studs are preferably sloped in the trailing direction from their inner ends.

12 Claims, 4 Drawing Sheets

BLADE-CARRYING DRUM ASSEMBLY FOR CHIP SLICING MACHINES

TECHNICAL FIELD

The present invention relates to wood chip slicing machines of the type having an outer rotating drum with chip cutting knife blades mounted therein adjoining discharge openings through the drum and having an inner anvil rotor rotating coaxially in the same direction as the drum but at a higher r.p.m. The rotor has radial arms carrying anvils which push chips held by centrifugal force against the inside face of the drum into contact with the blades so that they are sliced, whereupon the chip slices pass outwardly through the discharge openings.

BACKGROUND OF THE INVENTION

In previous wood chip slicing machines of the above-described type, the knife blades are located at the leading edge of the discharge openings, and the mouth of the discharge openings is defined by a gap between the knife blades and gauge plates which are mounted at the trailing side of the discharge openings. Wear plates of constant thickness are mounted on the inside of the drum between knife carriers and the gauge plates. The knife blades are held in position by knife clamps and backing shoulders in the knife carrier. The knife carrier in turn registers on a shoulder on the rotor.

In some installations, the knife blades are reversible to provide a second cutting edge and are discarded after both cutting edges are dulled. In other installations, blades are resharpened and the width of the blades is built up by babbitt to its original dimension after sharpening so that the backing shoulders will still accurately determine the location of the cutting edges. The gauge inserts also must be replaced from time to time.

SUMMARY OF THE INVENTION

This invention provides an improved mounting system for the knife blades and gauge inserts whereby the knife blades and gauge inserts can be more easily replaced and whereby the prior art knife carriers are eliminated by an arrangement using combination plates having wear plate and clamping functions. In accordance with the invention, the combination plates extend between the knife blades and gauge members which can be reversed to provide a second gauge edge before replacement. The drum is recessed at the outer edge of the leading side of each discharge opening to provide outwardly facing stop shoulders, which are engaged by stop feet on the clamping plates. Threaded studs pass outwardly from the combination plates through the drum and clamping plates, and form acute angles in the trailing direction with respect to drum radii passing through the inner anchored ends of the studs. When nuts on the studs are tightened, the knife blades are clamped between the trailing face of the combination plates and the clamping plates. During this clamping action, the combination plates are forced to move slightly in the trailing direction. In this regard, preferably the trailing face of the combination plates is beveled such as to form a slight outwardly facing dihedral angle with the leading face of the knife blades so that the combination plates will slightly deflect flush against the leading face of the knife blades when the nuts on the studs are tightened. While this tightening is being performed, the stop feet on the clamping plates are brought into engagement with the stop shoulders on the drum so as to be positively positioned. The stop feet are engaged by the outer edge of the knife blades when blades of the type to be resharpened are used, and are engaged by back-up bars when reversible blades are used. In the latter instance, the inner edge of the back-up bars, which engages the knife blades, is beveled in accordance with the bevels defining the cutting edges of the blades.

DETAILED DESCRIPTION OF THE INVENTION

Figure 1:
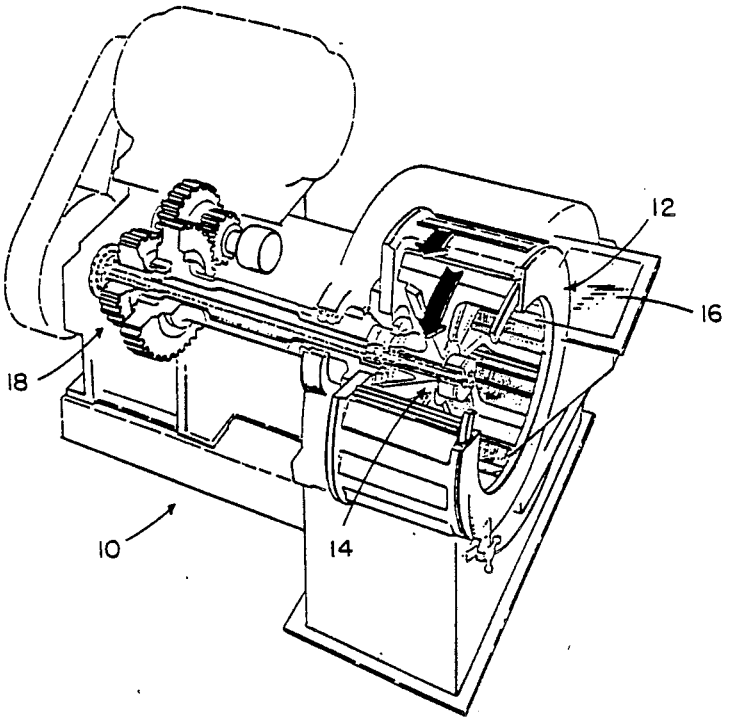
FIG. 1 is a perspective view showing a typical chip slicing machine to which the invention may be applied.

As previously discussed, the present invention applies to a chip slicing machine 10 of the type having a rotary blade-carrying drum 12 and a cooperating coaxial anvil rotor 14. The drum 12 has a back plate **12*g* and an open front surrounded by a ring 12*h*. As shown in FIG. 1, in such a machine the chip material to be sliced is fed into a hopper 16 on a door at the front of the machine housing which empties into the open front of the drum 12. A suitable drive mechanism 18 drives the drum 12 and anvil rotor 14 in the same direction as indicated by the arrows in FIG. 1, but drives the anvil rotor at a greater rotational speed. The anvil rotor 14 has radial vanes 20 on which anvils 21** are mounted. Since the invention is directed to the outer portion of the drum assembly, only this portion of the chip slicing machine is illustrated in detail.

Figure 2:
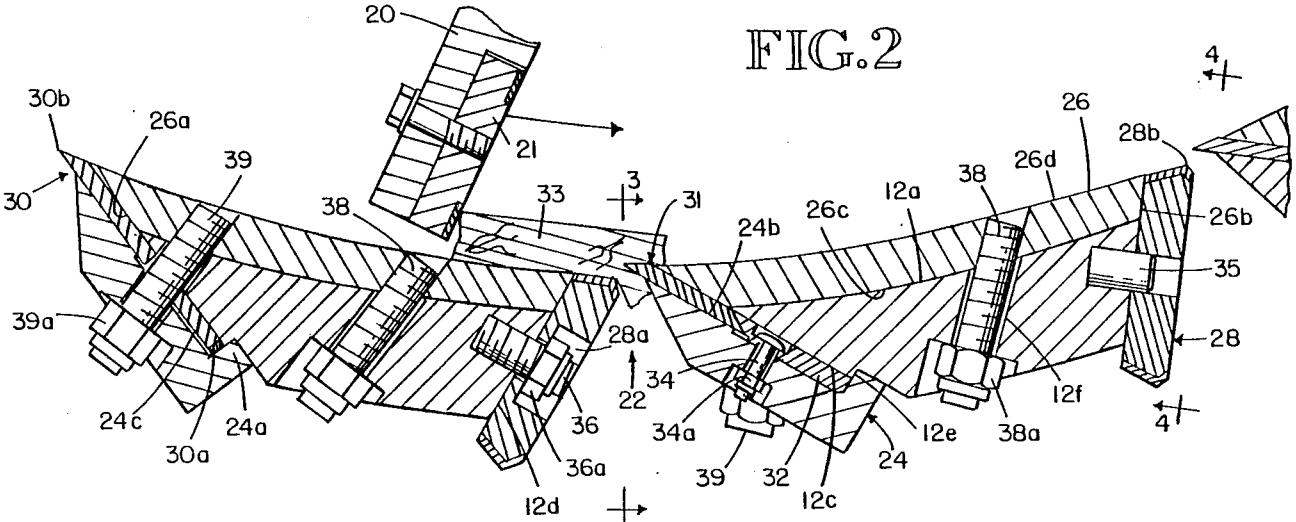
FIG. 2 is a fragmentary transverse cross-sectional view of the drum assembly illustrating a wood chip being sliced.
Figure 4:
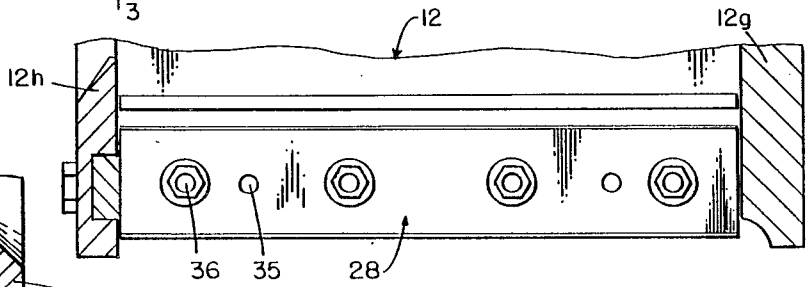
FIGS. 3 and 4 are fragmentary longitudinal sectional views taken as shown by lines 3—3 and 4—4 in FIG. 2.
Figure 3:
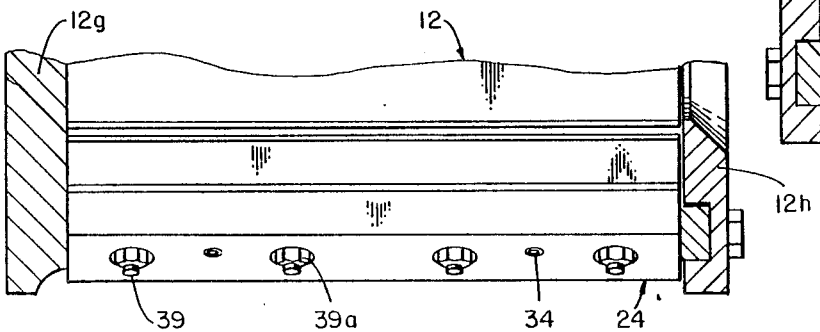

Referring to FIG. 2, the drum 12 for the chip slicing machine has a cylindrical inside face **12*a* interrupted by discharge openings 22 extending lengthwise of the rotor in parallel relation to the rotary axis of the rotor. The leading and trailing edges of each discharge opening 22 have respective sloped planar faces 12*c*, 12*d* which diverge outwardly from the mouth of the discharge opening. Adjacent the outside face of the rotor 12, each leading face 12*c* is recessed to provide a stop shoulder 12*e*. This shoulder is engaged by a stop foot 24*a* on an elongated clamping plate 24 which presents a leading clamping face 24*b* opposing a trailing clamping face 26*a* on the trailing end of a respective combination plate 26 which is seated by a convex outside surface 26*c* against the cylindrical inside face 12*c* of the drum 12**.

The combination plates 26 are designated "combination" because they have a wear plate function and a clamping function. Their leading engagement face **26*b* is overlapped by reversible gauge bars 28 which are accurately positioned by dowels 35 and receive rows of studs 36. The dowels 35 and studs 36 are anchored in the recesses 28*a* in the gauge bars. The gauge bars 28** have carbide-faced tapered edge portions defining a gauge tip edge 28b.

Figure 6:
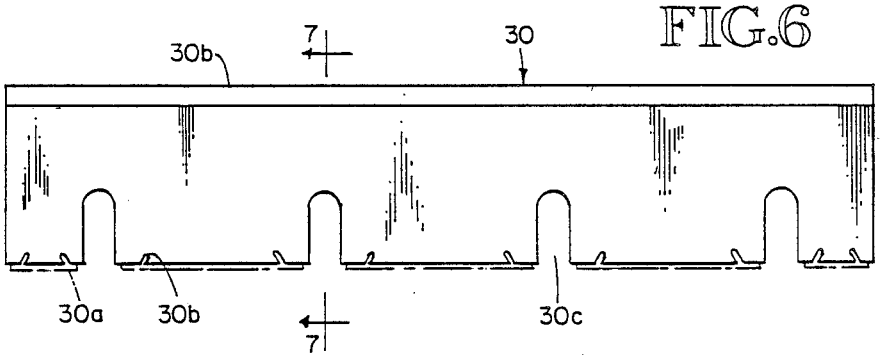
FIG. 6 is a plan view of a blade of the type intended to be resharpened.
Figure 7:
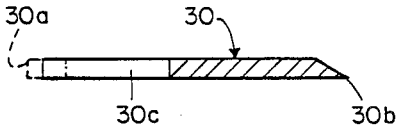
FIG. 7 is a transverse cross-sectional view taken as indicated by line 7—7 in FIG. 6.

Clamped between the complementing clamping faces 24b and 26a of the clamping plates 24 and combination plates 26 is an elongated knife blade, which may be a regrindable unit 30 or a disposable, reversible unit 31. One of each is shown in FIG. 2. The regrindable blade 30, best seen in FIGS. 6–7, has a babbitt portion 30a engaging the stop foot 24a. When the cutting edge 30b of the blade 30 wears, the blade is removed and sharpened, and additional babbitt is added by casting to such an extent that the overall width of the blade 30 plus babbitt 30a is the same as it was originally. The longitudinal edge of the blade 30 to which the babbitt is applied is preferably formed with notches 30b to assist connection of the babbitt to the blade. The portion of the clamping plate 24 between its clamping face 24b and the stop foot 24a is preferably recessed at 24c to provide clearance for excess babbitt on the adjacent edge of the blade 30.

Figure 5:
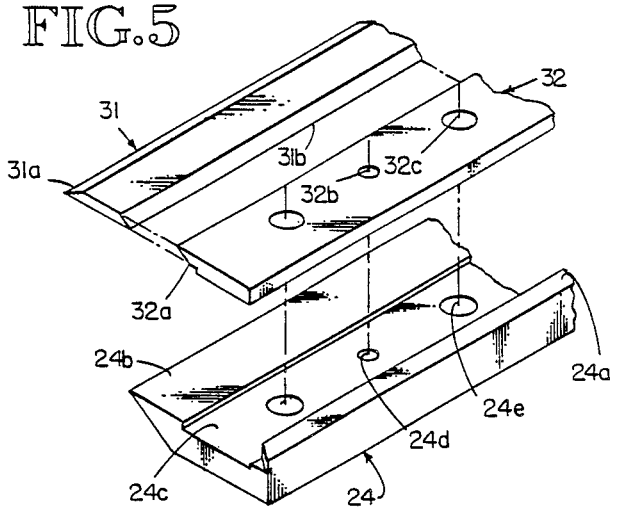
FIG. 5 is a perspective exploded view of a reversible disposable type of blade and related parts.

As best seen in FIG. 5, the disposable knife blade 31 has the shape of an isosceles trapezoid in end view and has two sharp edges 31a, 31b defining the ends of the base of the trapezoid. Backing the outer edges of the blades 31 are back-up bars 32 having a beveled inner end face 32a complementing the bevel at the cutting edges of the blades. The back-up bars 32 seat by their outer edges against the stop feet 24a and are secured to the clamping plates by bolts 34 passing through registering holes 32b, 24d in the back-up bars 32 and clamping plates 24, and having nuts 34a.

The outside surface 26c of the combination plates 26 is arched to match the curvature of the cylindrical inside face 12a of the drum 12, whereas the inside surface 26d of each combination plate 26 remains constant for about two-thirds of the distance from the trailing clamping face 26a to the leading engagement face 26b thereof, and then the inside surface 26d slopes outward tangentially toward the gauge bars 28. Thus, the radial thickness of each wear plate 26 at the leading engagement face 26b is less than at the trailing clamping face 26a . This thickness difference makes it possible to slice the chips. More specifically, the gauge edge 28b is substantially at the same radius from the drum axis as the leading edge of the inside surface 26d of the wear plates 26, and the cutting edge 30b of the chip slicing knives 30 (or edges 31a, 31b of the disposable knives 31) is located at a radius from the drum axis which is substantially the same distance as the radius of the trailing edge of the inside surface 26d of the combination plates. With this arrangement, the gap between the gauge edge 28b and adjoining cutting edge 30b establishes the thickness of the chip slices as can be seen from the cutting action in the oversized chip 33 in FIG. 2. Preferably the inside face 26d of each combination plate 26 is chrome plated for improved wear characteristics.

Each combination plate 26 has leading and trailing sets of threaded studs 38–39, respectively, anchored therein and projecting outwardly such that each stud forms an acute angle in the trailing direction from a drum radius extending through the inner anchored end thereof. The leading studs 38 extend from the combination plates 26 through oversized holes 12f in the drum 12 to receive nuts 38a , whereas the trailing studs 39 extend from the combination plates 26 through the drum 12 and holes 24e in the clamping plates 24 to receive nuts 39a. The nuts 38a and 39a seat in respective recesses formed at the outside of the drum and clamping plates 24. The knife blades 30 and back-up bars 32 have slots 30c and holes 32c therein for passage of the trailing studs 39.

Figure 8:
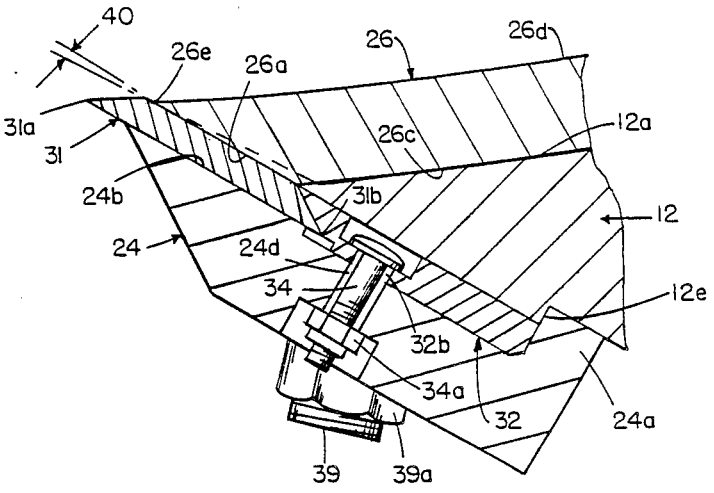
FIG. 8 is an enlarged central portion of FIG. 2 showing a reversible blade installed.

To install a knife blade 30, the blade is positioned against the leading edge surface 12c of a discharge opening 22 with the studs 39 projecting through the slots 30c. A clamping plate 24 is then positioned over the blade 30 so that the studs 39 pass through the clamping plate and the babbitt 30a on the outer edge of the blade 30 rests against the stop foot 24a. This is normally done after the nuts 38a have been applied to the leading set of studs 38, but not fully tightened. The nuts 39a are then threaded onto the studs 39 and tightened. This causes the stop foot 24a to bear against the corresponding stop shoulder 12e and the clamping face 24b of the clamping plate 24 to bear against the knife blade 30. At the same time, the respective combination plate 26 is forced in the trailing direction so that its trailing clamping face 26a also bears against the knife blade 30. As a result, the knife blade 30 is firmly clamped between the clamping face 24b of the clamping plate and the trailing clamping face 26a of the combination plate. In this regard, as indicated in FIG. 8, it is preferred to have the trailing clamping face 26a of the combination plates beveled such that when the inner edge 26e of the clamping face 26a initially engages the leading face of the knife blade in opposition to the clamping plate, there will be a small, outwardly diverging dihedral angle 40 (exaggerated in FIG. 8) present between the clamping face 26a and the knife blades. As a result, during the clamping action, the trailing edge portion of the combination plate 26 will be slightly deformed into firm flush engagement of the face 26a with the knife blade 30. Then the nuts 38a on the leading set of studs 38 are firmly tightened. Basically, the same mounting procedure is used to install a reversible-type blade 31, except that the back-up bar 32 is initially mounted on the clamping plate 24 by the bolts 34.

Removal of a knife blade 30 or 31 is easily accomplished by loosening the nuts 39a to release the respective clamping plate 24. In the case of a reversible blade 31, the overlap of the outer beveled edge of the blade 31 with respect to the beveled inner edge of the back-up bar 32 causes the blade 31 to come free together with the bar 32, thus making it easier to remove the blade The gauge bars 28 are easily installed by positioning them on the dowels 35 and studs 36, and then threading and tightening the nuts 36a on the studs 36. Removal of the gauge bars 28 for reversal or replacement is easily accomplished by removal of the nuts 36a without disturbing the rest of the drum assembly.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A drum assembly for a chip slicer, comprising:

a rotary drum having an outer wall with inside and outside surfaces interrupted by circumferentially spaced discharge openings, each of said discharge openings having a leading edge surface extending outwardly from said inside surface to said outside surface of the drum, said leading edge surface of each discharge opening being recessed to provide an outwardly directed stop shoulder;

combination wear and clamping plates engaging said inside surface of the drum and each having a trailing clamping face;

clamping plates each having a leading clamping face and having a stop foot at its outer end engaging a respective one of said stop shoulders;

chip slicing knife units clamped between said trailing clamping faces of the combination plates and said leading clamping faces of said clamping plates;

studs anchored at inner end portions in said combination plates and extending outwardly from the combination plates through openings in the outer wall of the drum rotor, some of said studs additionally extending outwardly through openings in said clamping plates; and nuts on said studs bearing against said drum or against said clamping plates.

2. A drum assembly according to claim 1 in which each of said studs forms an acute angle in the trailing direction with respect to a drum radius through its inner end so that tightening of said nuts not only forces said combination plates against the inside surface of the drum, but also applies force against said combination plates in the trailing direction so that the trailing clamping face of the combination plates bears against said knives.

3. A drum assembly according to claim 1 in which each combination plate has a leading engagement face, and gauge bars are mounted on said drum and overlap said leading engagement face of the combination plates.

4. A drum assembly according to claim 3 in which said gauge bars have gauge edge portions along opposite side edges thereof, and are reversible for alternate use of said gauge edge portions.

5. A drum assembly according to claim 1 in which some of said studs pass through slots in said knife units.

6. A drum assembly according to claim 1 in which said knife units bear against said stop feet on the clamping plates.

7. A drum assembly according to claim 1 in which said knife units each have a knife blade and a back-up element between the knife blade and the stop foot on the respective said clamping plate.

8. A drum assembly according to claim 1 in which said knife units include reversible blades having active and spare beveled cutting edges at opposite side edges, and in which back-up members are provided having a beveled edge behind said spare edge.

9. A drum assembly according to claim 1 in which said back-up members seat against said stop feet of the clamping plates, and some of said studs pass through said back-up members and clamping plates.

10. A drum assembly for a chip slicer, comprising:

a rotary drum having an outer wall with cylindrical inside and outside surfaces interrupted by circumferentially spaced discharge openings, each of said discharge openings having a leading edge surface and a trailing edge surface diverging outwardly from said inside face to said outside face of the drum, said leading edge surface of each discharge opening being recessed at its intersection with said outside face of the drum to provide an outwardly directed stop shoulder;

combination wear and clamping plates each having a convex outside surface engaging said inside surface of the drum and having a concave inside surface, each combination plate also having a leading engagement face and a trailing clamping face, said leading engagement faces and trailing clamping faces of the combination plates continuing inwardly of said drum from said trailing end surfaces and leading end surfaces, respectively, of said discharge openings, and the thickness of each wear plate being greater at its trailing clamping face than at its leading engagement face;

clamping plates each having a leading clamping face and having a stop foot at its outer end engaging a respective one of said stop shoulders;

chip slicing knives having leading faces engaged by said trailing clamping faces of the combination plates and having trailing faces engaged by said leading clamping faces of said clamping plates;

leading and trailing sets of studs anchored at inner end portions in said combination plates and extending outwardly from the combination plates through bores in the outer wall of the drum rotor, said second set also extending outwardly through said clamping plates; and nuts on said studs, the nuts on said leading sets of studs bearing against said drum and the nuts on said trailing set of studs bearing against said clamping plates, each of the studs in said leading and trailing sets forming an acute angle in the trailing direction with respect to a drum radius through its inner end so that tightening of said nuts not only forces said combination plates against said inside face of the drum, but also applies force against said combination plates in the trailing direction so that the trailing clamping face of the combination plates bears against said knives.

11. A drum assembly according to claim 10 in which gauge bars are mounted on said drum at the trailing edge surfaces of said discharge openings and overlapping the leading engagement faces of the combination plates, said knives extending radially inward of said drum further than said gauge bars do, whereby said gauge bars and knives define the thickness of chip slices being cut and discharged from said drum through said discharge openings when chips are advanced along the inner face of said combination plates.

12. A drum assembly according to claim 10 in which the clamping face of each combination plate makes a small dihedral angle with said leading face of the respective knife commencing at the intersection of the concave inside surface of the combination plate with the trailing clamping face of the combination plate, whereby the trailing clamping faces of the combination plates are slightly deflected when they are forced against said knives responsive to tightening of said nuts.

* * * * *